US010662833B2

(12) United States Patent
Ooi et al.

(10) Patent No.: US 10,662,833 B2
(45) Date of Patent: May 26, 2020

(54) OIL COOLER

(71) Applicant: MAHLE FILTER SYSTEMS JAPAN CORPORATION, Tokyo (JP)

(72) Inventors: Naoki Ooi, Kawagoe (JP); Hirokazu Watanabe, Kawagoe (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 908 days.

(21) Appl. No.: 14/553,039

(22) Filed: Nov. 25, 2014

(65) Prior Publication Data

US 2015/0144312 A1 May 28, 2015

(30) Foreign Application Priority Data

Nov. 26, 2013 (JP) ..... 2013-243427

(51) Int. Cl.

| | |
|---|---|
| ***F28D 9/00*** | (2006.01) |
| ***F01M 5/00*** | (2006.01) |
| ***F28F 9/02*** | (2006.01) |
| *F28D 21/00* | (2006.01) |

(52) U.S. Cl.

CPC ..... *F01M 5/002* (2013.01); *F28D 9/0043* (2013.01); *F28D 9/0062* (2013.01); *F28F 9/0234* (2013.01); *F28D 2021/0049* (2013.01)

(58) Field of Classification Search

CPC ..... F28F 9/0234
USPC ..... 165/167
See application file for complete search history.

(56) References Cited

U.S. PATENT DOCUMENTS

| | | | | |
|---|---|---|---|---|
| 4,592,414 | A * | 6/1986 | Beasley | F28D 1/0333 165/153 |
| 6,026,894 | A | 2/2000 | Bachinger | |
| 6,298,910 | B1 | 10/2001 | Komoda et al. | |
| 6,341,649 | B1 | 1/2002 | Joshi et al. | |
| 9,310,143 | B2 * | 4/2016 | Valente | F28D 7/16 |
| 2008/0202735 | A1 | 8/2008 | Geskes et al. | |

(Continued)

FOREIGN PATENT DOCUMENTS

| | | | |
|---|---|---|---|
| EP | 0 899 531 | A2 | 3/1999 |
| EP | 2 060 865 | A1 | 5/2009 |
| JP | 61-259086 | A | 11/1986 |

(Continued)

OTHER PUBLICATIONS

Extended European Search Report, dated Mar. 27, 2015, 6 pages.
Japanese Office Action, dated Jul. 18, 2017, 4 pages.

*Primary Examiner* — Jonathan Bradford
(74) *Attorney, Agent, or Firm* — Foley & Lardner LLP

(57) ABSTRACT

An oil cooler includes flat tubes layered together with a clearance, wherein cooling water flows through the clearance. Each flat tube includes a first plate, a second plate, and a fin plate held between the first plate and the second plate. The first plate is recessed to form a fin plate accommodation portion accommodating the fin plate, wherein a thin portion is formed outside of the fin plate accommodation portion in a longitudinal direction of the flat tube. An oil port is provided at the thin portion. Each flat tube includes a guide wall at a lateral periphery thereof, wherein the guide wall faces the oil port in a width direction, and projects in a layering direction. The guide wall, the thin portion, and a lateral wall of the oil port form a nozzle portion to guide cooling water in the longitudinal direction.

6 Claims, 7 Drawing Sheets

(56) References Cited

U.S. PATENT DOCUMENTS

| | | | | |
|---|---|---|---|---|
| 2009/0126911 | A1* | 5/2009 | Shore | F28D 1/0325 165/109.1 |
| 2013/0025835 | A1* | 1/2013 | Von Eckermann | F28D 9/0043 165/157 |

FOREIGN PATENT DOCUMENTS

| | | | |
|---|---|---|---|
| JP | 2000-283661 | A | 10/2000 |
| JP | 2001-99585 | A | 4/2001 |
| JP | 2002-267385 | A | 9/2002 |
| JP | 2013-524157 | A | 6/2013 |
| JP | 2014-043979 | A | 3/2014 |
| WO | WO-2007/009713 | A1 | 1/2007 |

* cited by examiner

OIL COOLER

BACKGROUND OF THE INVENTION

The present invention relates generally to an oil cooler for a larger-sized engine or the like, and particularly to an oil cooler configured to be mounted in a case in which cooling water flows.

Japanese Patent Application Publication (Translation of PCT Application) No. 2013-524157 (henceforth referred to as JP2013-524157) corresponding to United States Patent Application Publication 2013/025835 discloses an oil cooler including a plurality of flat tubes layered together with a clearance to one another in a layering direction, wherein the case allows cooling water to flow therein through the clearance in a longitudinal direction of the flat tubes, and wherein each flat tube allows working oil to flow therein. The oil cooler is employed in a state where the oil cooler is mounted in a case provided at a cylinder block or the like of a larger-sized engine. Cooling water of the engine is forced to circulate in the case, whereas working oil is sent under pressure to the oil cooler. The working oil is cooled by heat exchange with the cooling water. Japanese Patent Application Publication No. 2000-283661 (henceforth referred to as JP2000-283661) also discloses such an oil cooler.

The first plate and the second plate are formed of a clad material or the like, and joined to each other by brazing in a furnace in a state where a fin plate is sandwiched between the first and second plates.

Each plate of each flat tube 2 has an opening that serves as an oil inlet or oil outlet, wherein the periphery of the opening forms a cylindrical oil port, and the cylindrical oil port is connected to each other, to form a continuous oil inlet or outlet passage extending in the layering direction.

Heat exchange efficiency of such an oil cooler depends on flow rate and flow speed of cooling water flowing through the oil cooler. The oil cooler of JP2013-524157 is provided with an outer wall extending at a lateral periphery of the flat tube, and covering a lateral side of the flow passage of cooling water, to ensure flow of cooling water in the flow passage.

SUMMARY OF THE INVENTION

In the configuration of JP2013-524157, cooling water which has flown into the clearance between the flat tubes is prevented from outflowing by the outer wall at the periphery of the flat tube. However, at one longitudinal end portion of the oil cooler configured to receive inflow of cooling water, the clearance between two adjacent flat tubes is small so that cooling water does not smoothly flow into the inside of the oil cooler in the case. Moreover, the cylindrical oil port, which is formed at the longitudinal end portion of the oil cooler, crosses a flow path of cooling water between the flat tubes, further resisting the flow of cooling water flowing into the narrow flow passage.

In the configuration of JP2000-283661, the longitudinal end portion of each flat tube has a thin plate shape where a cylindrical member is provided at the center, so that as one end surface of the flat tube is viewed in the flow direction of cooling water, only a small space is left as a passage of cooling water flow at both sides of the cylindrical member. Accordingly, the inflow of cooling water into the passage between the flat tubes is not smooth.

In the configuration of JP2013-524157, the outer wall for preventing the outflow of cooling water extends nearly the entire length of the flat tube in the longitudinal direction.

This structure may unnecessarily cause an increase in the weight, and also make it difficult to check visually the state of brazing of the oil cooler. For example, if each flat tube is provided with a plurality of embossed portions (see JP2000-283661) which are brazed to the surface of the adjacent plate, the lateral side of the oil cooler is covered by the outer wall, so that during an inspection operation after a brazing operation in a furnace, it is impossible to visually recognize whether the apex of each embossed portion is joined to the surface of the corresponding plate, and therefore, a special inspection device is required.

In view of the foregoing, it is desirable to provide an oil cooler in which cooling water is smoothly guided into a cooling water passage between flat tubes, to improve heat exchange efficiency between working oil and cooling water, and allow to check visually the inside of the oil cooler.

According to one aspect of the present invention, an oil cooler comprises: a plurality of flat tubes layered together with a clearance to one another in a layering direction, and configured to be mounted in a case, wherein the case allows cooling water to flow therein through the clearance in a longitudinal direction of the flat tubes, and wherein each flat tube allows working oil to flow therein; wherein: each flat tube includes: a first plate; a second plate including a periphery joined with a periphery of the first plate; a fin plate held between the first plate and the second plate; and an oil port having a cylindrical shape having a longitudinal axis extending substantially in the layering direction, and provided at first longitudinal end portions of the first plate and the second plate configured to receive inflow of cooling water; each flat tube is connected to one another via the oil port; the first plate is recessed to form a fin plate accommodation portion accommodating the fin plate, wherein the first longitudinal end portion of the first plate is outside of the fin plate accommodation portion in the longitudinal direction of the flat tube; the second plate has a substantially flat shape covering the fin plate accommodation portion of the first plate; the first longitudinal end portion of the first plate and the first longitudinal end portion of the second plate are joined together to form a thin portion of the flat tube; the oil port is provided at the thin portion of the flat tube and located adjacent to the fin plate accommodation portion of the first plate; each flat tube includes a guide wall at a lateral periphery thereof, wherein the guide wall faces the oil port substantially in a width direction of the flat tube, and projects in the layering direction; and the guide wall, the thin portion, and a lateral wall of the oil port form a nozzle portion of the flat tube to guide cooling water in the longitudinal direction of the flat tube. The oil cooler may be configured so that each flat tube includes two of the oil ports arranged in the width direction; each flat tube includes an inter-port passage formed between the oil ports, wherein the inter-port passage extends from the thin portion to an adjacent longitudinal end of the fin plate accommodation portion; and the inter-port passage includes a slope connected between a level of the thin portion and a level of the fin plate accommodation portion. The oil cooler may be configured so that the lateral wall of the oil port includes a base portion extending toward an adjacent longitudinal end of the fin plate accommodation portion with expanding in the width direction of the flat tube. The oil cooler may be configured so that: the base portion of the lateral wall of the oil port includes a slope at a portion expanding in the width direction of the flat tube; and the slope is connected between a level of the thin portion and a level of the fin plate accommodation portion. The oil cooler may be configured so that the guide wall extends in a range covering an adjacent longitudinal end of the fin plate accommodation portion in the longitudinal direction of the flat tube. The oil cooler may be configured so that: the oil cooler includes a plurality of embossed portions provided in each clearance for keeping each clearance; and the guide wall extends substantially between a central portion of the oil port and one of the embossed portions in the longitudinal direction of the flat tube, wherein the one of the embossed portions is most adjacent to the oil port in the longitudinal direction of the flat tube.

DETAILED DESCRIPTION OF THE INVENTION

Figure 1:
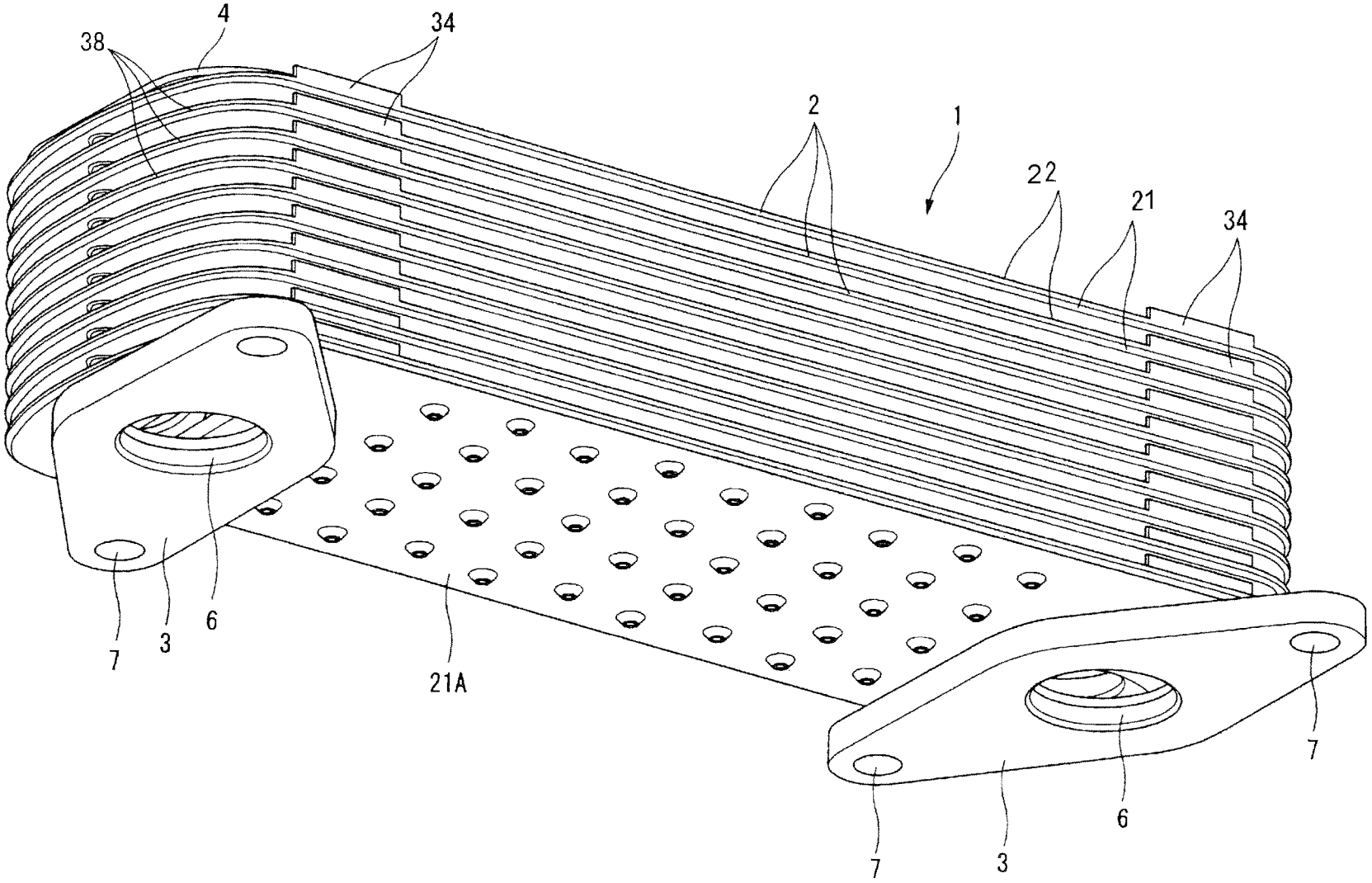
FIG. 1 is a perspective view of an oil cooler according to an embodiment of the present invention.
Figure 2:
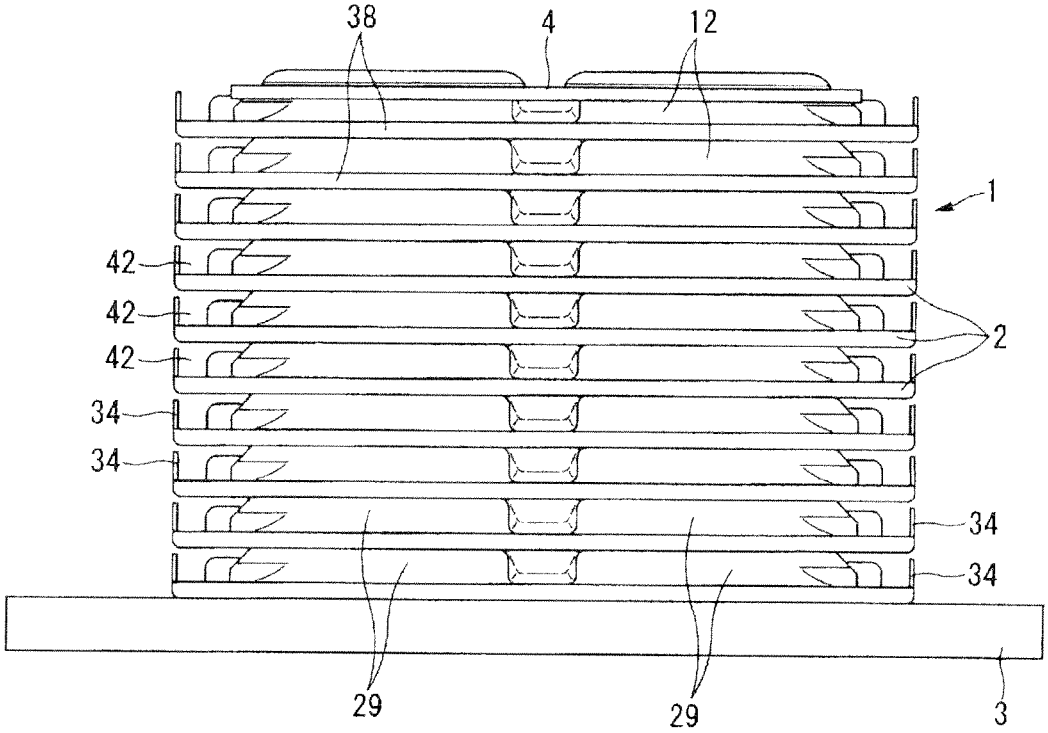
FIG. 2 is a front view of the oil cooler of FIG. 1.
Figure 3:
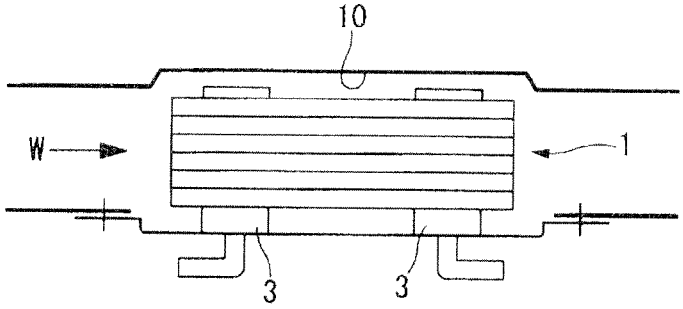
FIG. 3 is an illustration showing a condition where the oil cooler of FIG. 1 is mounted in a case.

FIGS. 1 and 2 show an oil cooler 1 according to an embodiment of the present invention. The oil cooler 1 is configured to cool lubricating oil in a larger-sized engine. The oil cooler 1 includes a plurality of flat tubes 2 layered together with a clearance in a layering direction. Each flat tube 2 has an internal space as an oil passage 11 (see FIG. 6) to allow working oil to flow therein in a longitudinal direction of the flat tube 2. The clearance between two adjacent flat tubes 2 serves as a cooling water passage 12 (see FIG. 6) to allow cooling water to flow therein in the longitudinal direction of flat tube 2. The number of layered flat tubes 2 may be changed to adjust overall capacity of heat exchange of the oil cooler 1. The oil cooler 1 is thus configured as a multi-plate heat exchanger. The oil cooler 1 is employed under a condition that the oil cooler 1 is mounted in a case 10 in which cooling water W flows in the longitudinal direction of the case 10, as shown in FIG. 3. The case 10 may be formed as a recess in a cylinder block of the engine, or separately formed in a box shape.

As shown in FIGS. 1 and 2, the oil cooler 1 includes the plurality of flat tubes 2, a pair of mounting flanges 3, and a pair of reinforcement plates 4. The mounting flanges 3 form an inlet port and an outlet port of working oil, respectively. The reinforcement plates 4 are arranged to face the mounting flanges 3 through the plurality of flat tubes 2.

In the following description, for ease of explanation and understanding, terms "upper", "lower", etc. are used with reference to the posture of the oil cooler 1 shown in FIGS. 1 and 2. Namely, the mounting flanges 3 are referred to as being located at a "lower" side of the oil cooler 1, whereas the reinforcement plates 4 are referred to as being located at an "upper" side of the oil cooler 1. However, it is to be noted that the oil cooler 1 may be mounted in a vehicle or the like with the posture of the oil cooler 1 arbitrarily set (not limited to the posture shown in FIGS. 1 and 2).

Each flat tube 2 has a narrow shape as a whole for allowing working oil to flow in its longitudinal direction, and has a longitudinal end portion having a curved shape, specifically, a substantially semicircular shape. The mounting flanges 3 are arranged at corresponding longitudinal end portions of the flat tube 2. Each mounting flange 3 is formed of a relatively thick plate having a rhombic shape or elliptical shape, and has a circular opening 6 at its center, and a pair of mounting holes 7 at its corresponding ends. The circular opening 6 serves as an inlet or outlet of working oil from or to the engine. Each reinforcement plate 4 is formed of a relatively thick plate, and has a periphery having a shape corresponding to the semicircular shape of the longitudinal end portion of the flat tube 2.

Figure 4:
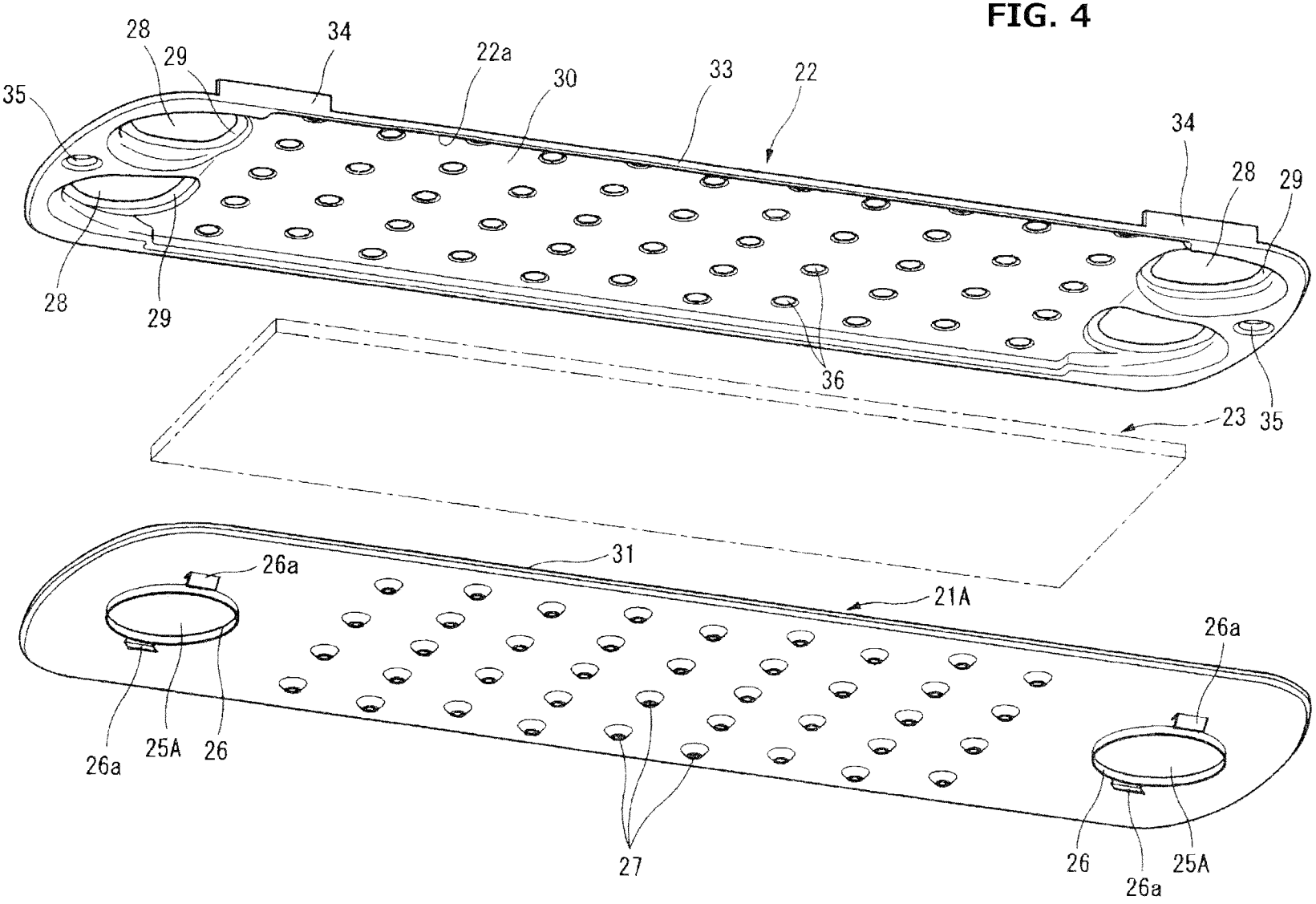
FIG. 4 is a perspective exploded view of a lowest one of flat tubes of the oil cooler of FIG. 1.
Figure 5:
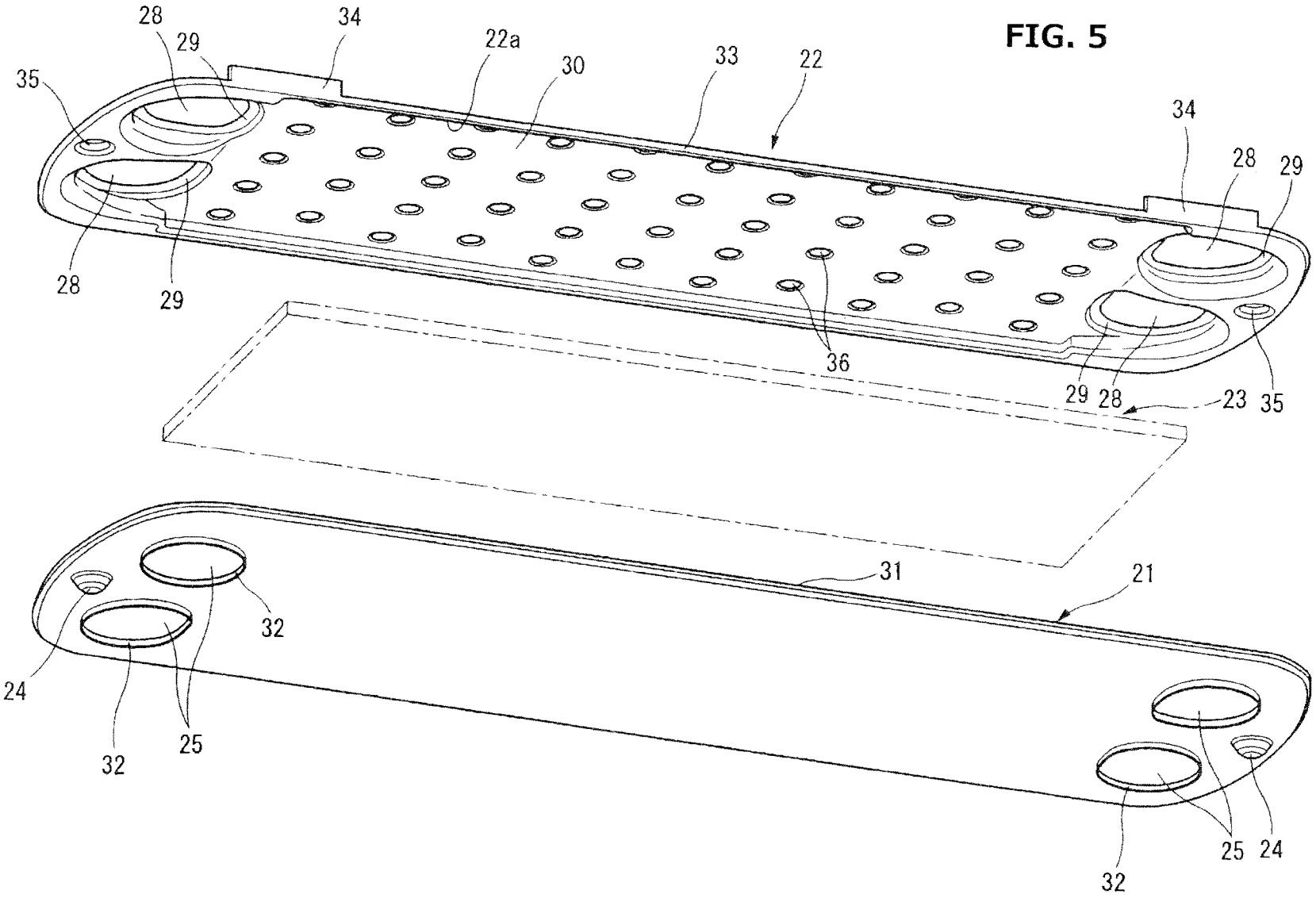
FIG. 5 is a perspective exploded view of one of the flat tubes of the oil cooler of FIG. 1 other than the lowest one.

As shown in FIGS. 4 and 5, each flat tube 2 includes a lower plate 21, an upper plate 22, and a fin plate 23, wherein the fin plate 23 is disposed and held between the lower plate 21 and the upper plate 22. The lower plates 21, the upper plates 22, the fin plates 23, the mounting flanges 3, and the reinforcement plates 4 are made of metal such as stainless steel or iron, and temporarily assembled, and then heated in a furnace, and thereby fixedly assembled by brazing. Each member is made of a so-called clad material which is formed by coating a surface of a base metal with a brazing material. However, each member may be made of another material, and a separate brazing material may be used at the time of brazing.

The lower plate 21 of each flat tube 2 has identical configuration except for the lower plate 21A of the lowest flat tube 2 shown in FIG. 4. As shown in FIG. 5, lower plate 21 has a generally relatively thin flat plate shape, and has a flange 31 at its periphery, wherein the flange 31 extends all over the entire periphery and projects slightly in the layering direction. Lower plate 21 has first and second longitudinal end portions, each of which is formed with a pair of substantially circular openings 25 arranged in the width direction of lower plate 21. The periphery of each opening 25 is bent downward to project slightly to form a cylindrical portion 32 which serves to position the lower plate 21 with respect to the upper plate 22 of another lower flat tube 2. Each longitudinal end portion of the lower plate 21 is also formed with a longitudinal end projection 24 which projects downward to form a circular boss. The longitudinal end projection 24 is located outside of the openings 25 in the longitudinal direction of lower plate 21, and is located between the pair of openings 25 in the width direction of flat tube 2.

The lower plate 21A of the lowest flat tube 2 has first and second longitudinal end portions, each of which is formed with a single circular opening 25A, as shown in FIG. 4. The lower plate 21A has a flange 31 at its periphery, similar to the lower plate 21. The center of the opening 25A is located at the center of the flat tube 2 in the width direction of the flat tube 2 such that the opening 25A overlaps partially with both of the pair of openings 25 of each of the other flat tubes 2. The opening area of the opening 25A is larger than that of each opening 25. The opening 25A corresponds to the circular opening 6 of the corresponding mounting flange 3. The periphery of the opening 25A is bent downward to from a cylindrical portion 26 having a short cylindrical shape. As shown in FIG. 1, each mounting flange 3 is brazed to the underside of the lower plate 21A of the lowest flat tube 2, wherein the cylindrical portion 26 is fitted with the inner periphery of the circular opening 6 of the mounting flange 3.

Each longitudinal end portion of the lower plate 21A is formed with a pair of engagement nails 26*a* disposed on respective lateral sides of the opening 25A, for positioning the mounting flange 3. Moreover, the lower plate 21A is provided with a plurality of embossed portions 27, for avoiding adhesion with a jig not shown which is used during brazing in a furnace.

The upper plate 22 of each flat tube 2 has a flange 33 at its periphery, wherein the flange 33 slightly projects upward in the layering direction, and extends all over the entire periphery, as shown in FIGS. 4 and 5. The upper plate 22 has a slightly smaller outside shape than the lower plate 21 (21A) such that the outer surface of the flange 33 of the upper plate 22 is fitted intimately with the inner surface of the flange 31 of the lower plate 21 (21A). The upper plate 22 has first and second longitudinal end portions, each of which is formed with a pair of openings 28 having a substantially circular shape, corresponding to the pair of openings 25 of the corresponding longitudinal end portion of the lower plate 21. The periphery of each opening 28 is bent to project upward, to form a boss portion 29 annularly surrounding the opening 28. In other words, the substantially circular boss portion 29 is formed to project upward, and the opening 28 is formed in the center of the boss portion 29.

The upper plate 22 has an intermediate portion in the longitudinal direction, which is recessed upward to from a fin plate accommodation portion 30. The fin plate accommodation portion 30 has a rectangular shape corresponding to the rectangular shape of the fin plate 23, and has a depth corresponding to the thickness of the fin plate 23. Accordingly, the upper plate 22 has a recessed shape as the fin plate accommodation portion 30 at the intermediate portion, and has a joint surface 22*a* left at the periphery, wherein the joint surface 22*a* faces downwardly. The pair of openings 28 at each longitudinal end portion are located adjacent to a closer longitudinal end of the fin plate accommodation portion 30, so that the internal space of the boss portion 29 communicates with the internal space of the fin plate accommodation portion 30. Namely, the longitudinal end of the fin plate accommodation portion 30 which is formed by recessing in a stepwise manner with respect to the joint surface 22*a* that is a reference surface of the base material, is opened to the internal space of the boss portion 29. Guide walls 34 are provided on corresponding lateral sides of the pair of openings 28, wherein each guide wall 34 is formed as an extension projecting from a part of the flange 33. As shown in FIG. 1, the guide wall 34 has a narrow shape having a longitudinal axis extending in the longitudinal direction of the flat tube 2, and projects upward in the layering direction of the flat tubes 2.

Each longitudinal end portion of the upper plate 22 is formed with a longitudinal end projection 35 which corresponds to the longitudinal end projection 24 of the lower plate 21, and projects upward to form a circular boss shape. The longitudinal end projection 35 is located outside of the boss portions 29 in the longitudinal direction of the flat tube 2, and located between the pair of openings 28 in the width direction of the flat tube 2.

The intermediate portion of the upper plate 22 in the longitudinal direction, which is a bottom wall of the fin plate accommodation portion 30, is formed with many embossed portions 36, each of which projects upward to form a conical or semispherical shape. The apex of each embossed portion 36 is identical in height level to the top surface of each boss portion 29 surrounding the opening 28.

Figure 7:
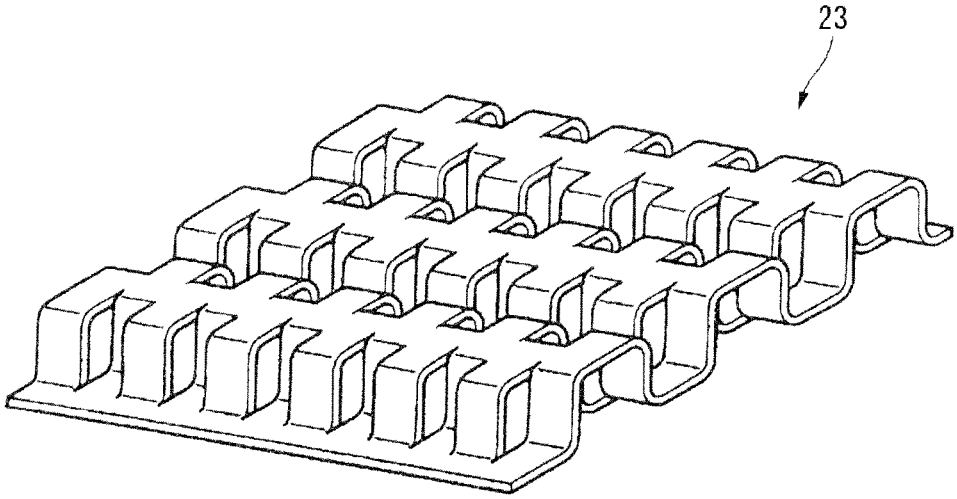
FIG. 7 is an enlarged partial perspective view of a fin plate of the oil cooler of FIG. 1.

As shown in FIGS. 4 and 5, the fin plate 23 has a simply rectangular outside shape, and has such a size to be fitted in the fin plate accommodation portion 30. As shown in FIG. 7, the fin plate 23 is a corrugate fin produced by forming many slits in a base material sheet to obtain many swaths, and bending each swath into a rectangular shape or U-shape at even pitches. In this example, the fin plate 23 is an offset-type corrugate fin in which corrugated shapes of two adjacent swaths are shifted from each other by a half pitch. However, the fin plate 23 is not limited to such an offset-type corrugate fin.

The lower plate 21 (21A) and the upper plate 22, which are configured as described above, are joined together by brazing in the state where the fin plate 23 is sandwiched between the lower plate 21 and the upper plate 22. Specifically, the lower plate 21 (21A) and the upper plate 22 are coupled by brazing in the state where the flange 33 of the upper plate 22 is fitted inside of the flange 31 of the lower plate 21 (21A), and the joint surface 22*a* of the periphery of the upper plate 22 is placed on the upper surface of the lower plate 21. Accordingly, the fin plate accommodation portion 30 in the form of the recessed shape is covered by the generally flat lower plate 21 (21A), to form a hermetically sealed oil passage 11. The fin plate 23 has some thickness because of the provision of the corrugate shape, where the lower surface of the fin plate 23 is brazed to the lower plate 21, and the upper surface of the fin plate 23 is brazed to the upper plate 22.

With regard to the entire oil cooler 1, the plurality of flat tubes 2 are layered with each other, and brazed to each other to form an integrated unit. Specifically, each boss portion 29 around the opening 28 of the upper plate 22 of each flat tube 2 is brazed to the periphery of the opening 25 of the lower plate 21 of the upper adjacent flat tube 2, whereas the apex of each embossed portion 36 of the upper plate 22 is brazed to the underside of the lower plate 21 of the upper adjacent flat tube 2. Moreover, the longitudinal end projection 24 and the longitudinal end projection 35 at the longitudinal end side are made to face each other and brazed to each other. This configuration serves to ensure the clearance between the upper plate 22 of one flat tube 2 and the lower plate 21 of the upper flat tube 2, wherein the clearance forms the cooling water passage 12, and connect the flat tubes 2 in the state where each opening 28 of the upper plate 22 and the corresponding opening 25 of the lower plate 21 to communicate with each other. In this way, under the condition where the plurality of flat tubes 2 are layered, the opening 25, and the opening 28, and the boss portion 29 form a cylindrical oil port 37, wherein the oil port 37 constitutes a passage continuous in the layering direction connect the oil passages 11 of the flat tubes 2 to each other. The top end of the continuous oil passage extending in the layering direction is closed by the reinforcement plate 4. Alternatively, the upper plate 22 of the top flat tube 2 may be configured without the provision of the openings 28.

During the brazing operation, each cylindrical portion 32 at the periphery of the opening 25 of the lower plate 21 is fitted in the corresponding opening 28 of the upper plate 22, to position the lower plate 21 of the upper flat tube 2 and the upper plate 22 of the lower flat tube 2 with respect to each other.

Figure 10:
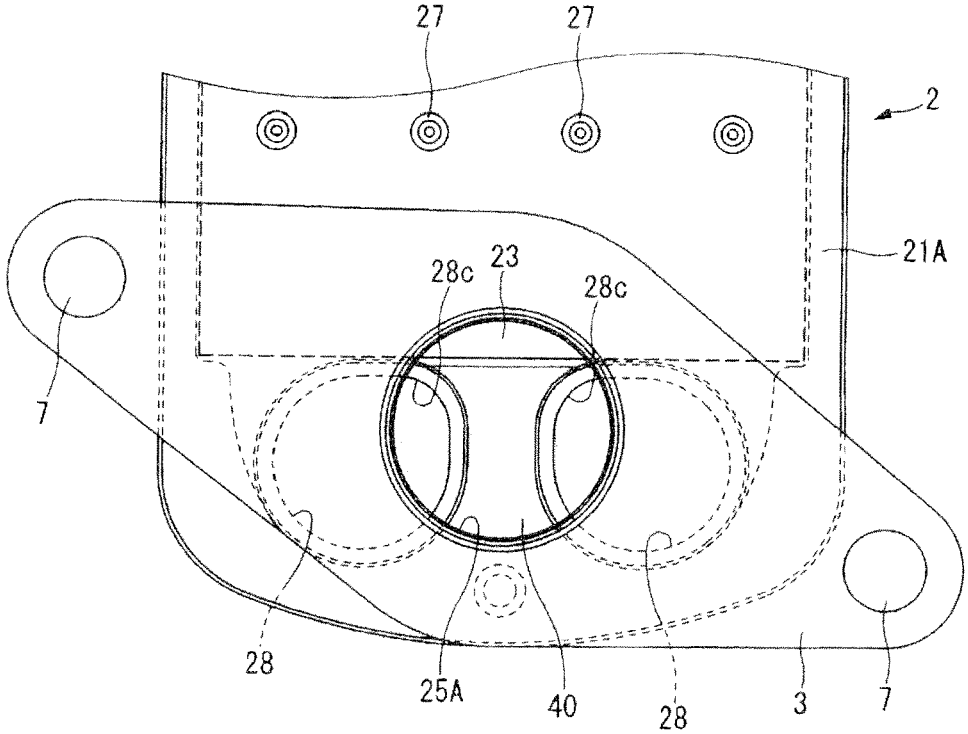
FIG. 10 is a partial plan view of one longitudinal end portion of the oil cooler from its lower side.

With regard to the lowest flat tube 2, the lower plate 21A including the single opening 25A per one longitudinal end portion and the upper plate 22 including the pair of openings 28 per one longitudinal end portion are assembled as shown in FIG. 4, the mounting flange 3 is attached to the underside of the opening 25A. FIG. 10 shows the mounting flange 3 and the surroundings from below. As shown in FIG. 10, the pair of openings 28 partially face the inside of the opening 25A. Accordingly, at the oil inlet side, working oil which has flown from the single opening 25A is separated into the pair of openings 28, whereas at the oil outlet side, working oil which has flown from the pair of openings 28 merges with each other into the single opening 25A.

The oil cooler 1, which are integrated by brazing as described above, is employed in the state where the oil cooler 1 is mounted in the case 10 where cooling water flows, as described above (see FIG. 3). The cooling water W, which is forced to circulate by a water pump not shown for the engine, flows in the longitudinal direction of the case 10. On the other hand, working oil inflows through the circular opening 6 of one mounting flange 3, and outflows through the circular opening 6 of the other mounting flange 3, wherein the working oil flows from the first longitudinal end to the second longitudinal end in each flat tube 2 of the oil cooler 1. The direction of flow of working oil may be identical or opposite to the direction of flow of cooling water.

Figure 6:
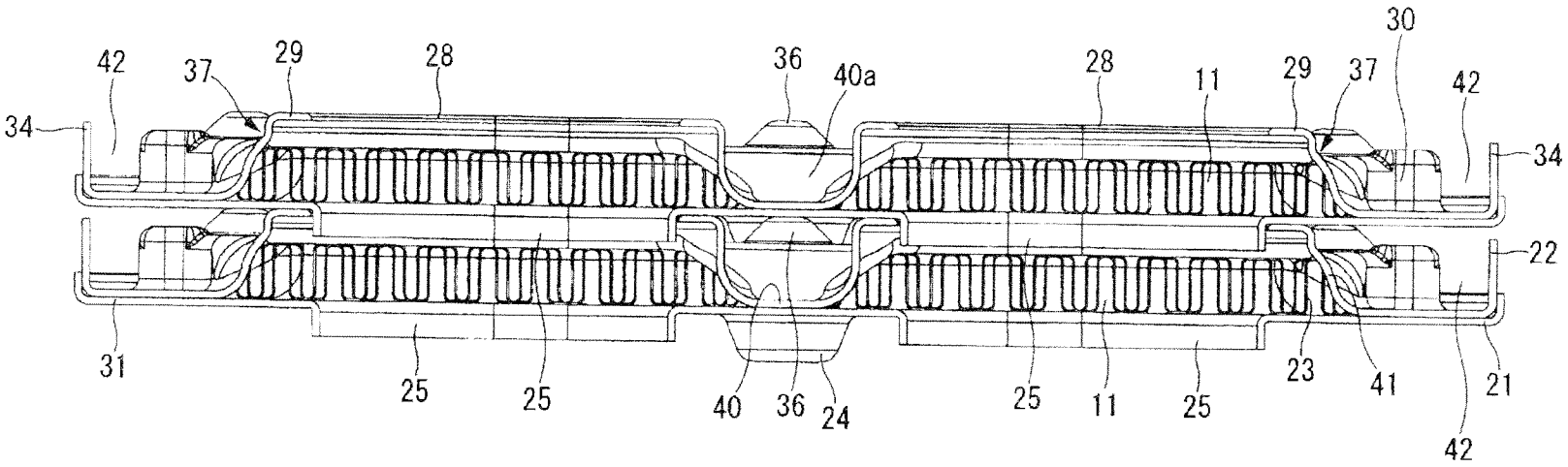
FIG. 6 is a partial sectional view of two layered flat tubes taken along a plane indicated by a line A-A in FIG. 8.
Figure 8:
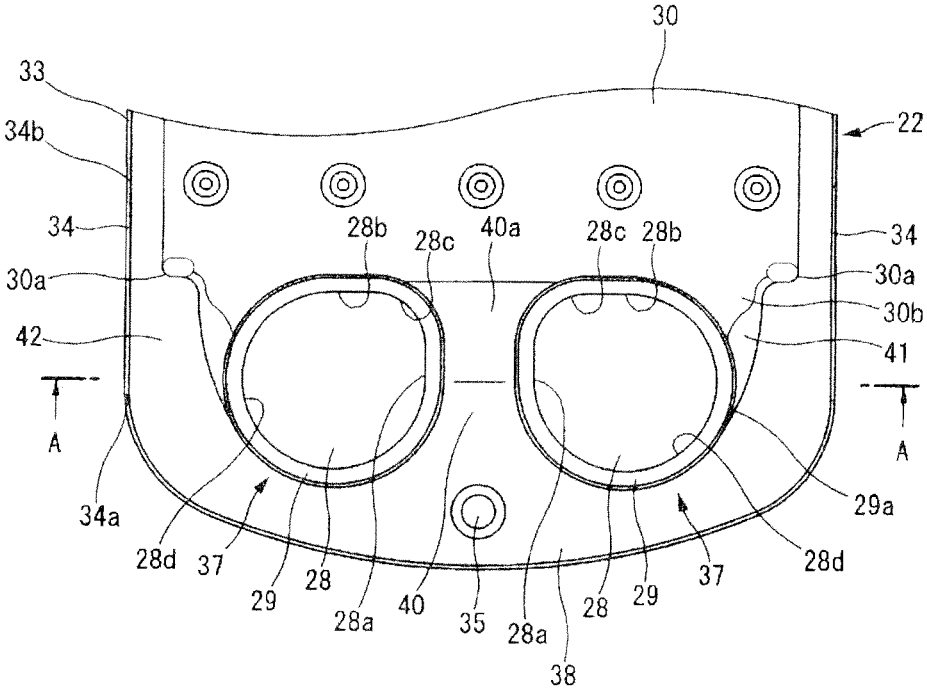
FIG. 8 is a partial plan view of an upper plate of the flat tube of FIG. 5.
Figure 9:
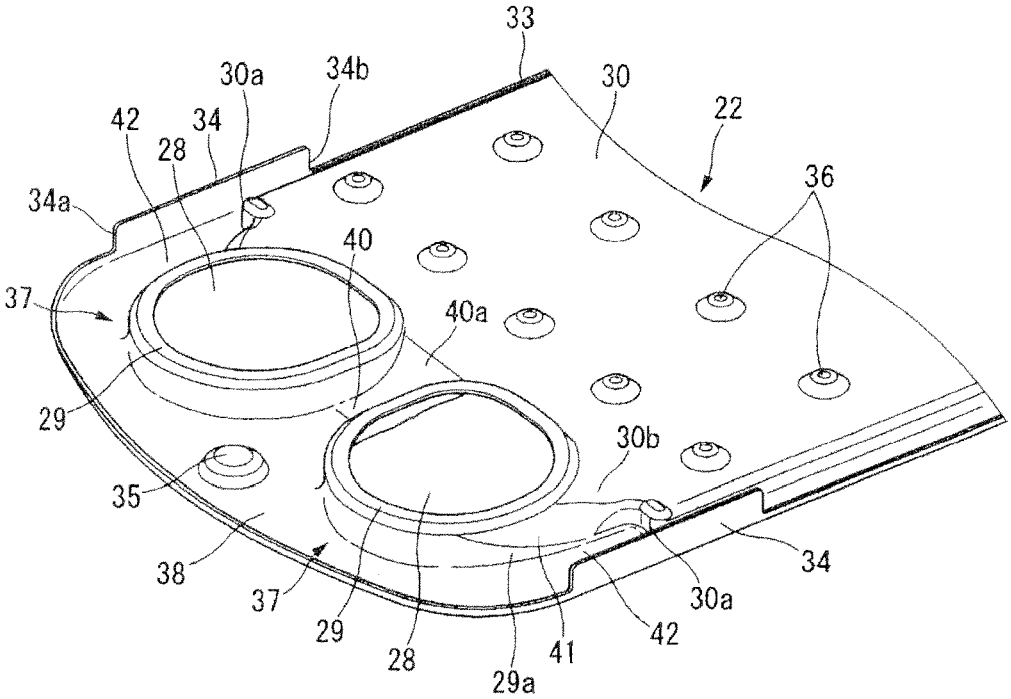
FIG. 9 is a partial perspective view of the upper plate of the flat tube of FIG. 5.

The following describes detailed configuration of the first longitudinal end side of each flat tube 2 which is configured as a cooling water inlet side to receive inflow of cooling water, with reference to FIGS. 6, 8 and 9. In this embodiment, the second longitudinal end side of each flat tube 2 which is configured as a cooling water outlet side to allow outflow of cooling water has the same configuration as the first longitudinal end side. Namely, each plate 21, 22, 23 is configured symmetrically. This is advantageous in processing and assembling of the plates. However, the cooling water outlet side may be modified to be different from the cooling water inlet side. In the following description, the flow of cooling water and others are on the assumption that the longitudinal end portion shown in the figures is of the cooling water inlet side.

As described above, the upper plate 22 includes the rectangular fin plate accommodation portion 30 corresponding to the fin plate 23, and the flat lower plate 21 is placed on the underside of the upper plate 22 to cover the fin plate accommodation portion 30. Accordingly, in the region outside of the fin plate accommodation portion 30 in the longitudinal direction of the flat tube 2, the flat tube 2 has no space between the upper plate 22 and the lower plate 21, but forms a thin portion 38 having a thickness substantially equal to the sum of the thickness of the upper plate 22 and the thickness of the lower plate 21. Accordingly, in the state where the plurality of flat tubes 2 are layered to form the oil cooler 1, the clearance between two adjacent flat tubes 2, which forms the cooling water passage 12, is smaller in the region of the fin plate accommodation portion 30, and is larger in the region of the thin portion 38. In each flat tube 2, the height level of the upper surface at the fin plate accommodation portion 30 is higher than that at the thin portion 38.

Each of the pair of oil ports 37 (namely, boss portions 29) individually projects upwardly from the thin portion 38 to form a cylindrical shape, wherein a portion (a portion closer to the center of the flat tube 2 in the longitudinal direction) of the outer periphery of each oil port 37 is formed continuous with the fin plate accommodation portion 30. Accordingly, each flat tube 2 includes an inter-port passage 40 formed between the two adjacent oil ports 37, wherein the inter-port passage 40 extends from the thin portion 38 to the adjacent longitudinal end of the fin plate accommodation portion 30. The inter-port passage 40 has a recessed shape extending from the longitudinal end portion of the flat tube 2 in the longitudinal direction of the flat tube 2. The boundary portion of the inter-port passage 40 with the fin plate accommodation portion 30, which is one longitudinal end portion of the inter-port passage 40, is formed with a slope 40*a* smoothly connected between the height level of the thin portion 38 and the height level of the upper surface of the fin plate accommodation portion 30. In the shown example, the slope 40*a* is in the form of an arc surface smoothly continuous with the upper surface of the thin portion 38. However, the slope 40*a* may be in the form of a flat slope. The provision of the slope 40*a* serves to suppress instability of the flow due to the difference in the height level between the thin portion 38 and the fin plate accommodation portion 30.

In the present embodiment, each opening 28 of the upper plate 22 has a non-circular shape, but its periphery is defined by a straight portion 28*a*, a straight portion 28*b*, a corner portion 28*c*, and an arc portion 28*d*. The straight portion 28*a* faces the other opening 28. The straight portion 28*a* extends in the longitudinal direction of the flat tube 2. The straight portion 28*b* is located closer to the center of the flat tube 2 in the longitudinal direction, and extends in the width direction of the flat tube 2. In the lowest flat tube 2, the corner portion 28*c* between the straight portion 28*a* and the straight portion 28*b* is located in the single opening 25A of the lower plate 21A as viewed in the layering direction as shown in FIG. 10. In the shown example, the corner portion 28*c* has an arc shape of a relatively small radius. The arc portion 28*d* of the opening 28 has an arc shape tangent to the straight portion 28*a* and to the straight portion 28*b*. In each flat tube 2 other than the lowest flat tube 2, each of the pair of openings 25 has a non-circular shape similar to the opening 28.

The lateral side of the boss portion 29 forming the oil port 37 facing the periphery of the flat tube 2 has a base portion, and the base portion is a port-side guide wall 29*a* extending from the outer peripheral surface of the boss portion 29 to the longitudinal end of the fin plate accommodation portion 30 with expanding in the width direction of the flat tube 2. Moreover, the longitudinal end portion of the fin plate accommodation portion 30 includes corner portions 30*a* each of which is located at a corresponding end of the flat tube 2 in the width direction, for positioning the fin plate 23, wherein the angle of the corner portion 30*a* is equal to about 90 degrees. An extension part 30*b* which is an extension of the bottom wall of the fin plate accommodation portion 30 in the longitudinal direction of the flat tube 2 is located between the corner portion 30*a* and the oil port 37 (boss portion 29). The outer shape of the extension part 30*b* is defined by the outer peripheral surface of the upper half of the boss portion 29 and the port-side guide wall 29*a*. Inside of the flat tube 2, the extension part 30*b* forms a substantially triangular space continuous with the rectangular shape of the fin plate accommodation portion 30. In the region of the lateral periphery of the extension part 30*b*, namely, in the region where the port-side guide wall 29*a* intersects with the extension part 30*b*, a slope 41 is provided and connected between the height level of the surface of the thin portion 38 and the height level of the upper surface of the fin plate accommodation portion 30. The slope 41 may be implemented by a flat slope or a curved slope.

Each flat tube 2 includes a guide wall 34 at a lateral periphery thereof, wherein the guide wall 34 faces the oil port 37 substantially in the width direction of the flat tube 2, and projects upward in the layering direction further from the flange 33. The guide wall 34 extends in a range covering the adjacent longitudinal end (i.e. the corner portion 30*a*) of the fin plate accommodation portion 30 in the longitudinal direction of the flat tube 2. As shown in FIG. 8, the guide wall 34 includes a first longitudinal end 34*a* slightly outside (closer to the longitudinal end of the flat tube 2) of the center of the boss portion 29 or opening 28, and includes a second longitudinal end 34*b* slightly outside (closer to the longitudinal end of the flat tube 2) of the center of one of the embossed portions 36 closest to the longitudinal end of the flat tube 2.

The guide wall 34 configured as described above faces the port-side guide wall 29*a* with a suitable clearance, wherein the port-side guide wall 29*a* extends from the oil port 37. Accordingly, in the state where the plurality of flat tubes 2 are layered, the guide wall 34, the port-side guide wall 29*a*, the upper thin portion 38, and the lower thin portion 38 form a nozzle portion 42. The nozzle portion 42 is in the form of a narrow space extending in the longitudinal direction of the flat tube 2, having a longitudinal end facing the longitudinal end of the flat tube 2, and a longitudinal end facing the corner portion 30*a*. Since the port-side guide wall 29*a* has a shape that gradually expands in the width direction of the flat tube 2, the nozzle portion 42 has a shape slightly narrowing toward its distal end.

As shown in FIGS. 1 and 2, the guide wall 34 has an upper periphery basically out of contact with the upper flat tube 2. The upper periphery is extended upward maximally in a range where the upper periphery is out of contact with the upper flat tube 2.

The following describes the flow of cooling water in the oil cooler 1 configured as described above. The configuration that in the state where the plurality of flat tubes 2 are layered, the longitudinal end portion of each flat tube 2 is in the form of the thin portion 38, serves to achieve a large opening area of the inlet where cooling water flows into the inside of the oil cooler 1, as viewed in the direction of flow of cooling water, and thereby allows cooling water to flow smoothly into the oil cooler 1 in the case 10. The cooling water which has flown along the surface of the thin portion 38 at the longitudinal end portion collides with the cylindrical oil ports 37 and thereby separates to the left and right sides of each oil port 37, and flows toward the downstream side through the pair of left and right nozzle portions 42 and the central inter-port passage 40. In this situation, the feature that the nozzle portion 42 is defined and surrounded by the guide wall 34, the port-side guide wall 29*a*, the lower thin portion 38, and the upper thin portion 38, serves to guide cooling water to flow straight in the longitudinal direction of the flat tube 2, and fast toward the downstream side. Accordingly, the cooling water flowing in the lateral direction from the oil port 37 is induced toward the downstream side by the fast flow through the nozzle portion 42. In this way, the cooling water is efficiently guided in the cooling water passage 12 that is a relatively small clearance between two adjacent fin plate accommodation portions 30. The configuration that the slope 41 is formed along the port-side guide wall 29*a* serves to allow cooling water to smoothly flow to the upper surface of the fin plate accommodation portion 30, and allow part of cooling water to flow to the back side of the oil ports 37, although the height level of the upper surface of the thin portion 38 and the height level of the upper surface of the fin plate accommodation portion 30 in the nozzle portion 42 are different from each other.

At the central region in the width direction, the inter-port passage 40 in the form of the recess guides cooling water. The configuration that the inter-port passage 40 is connected smoothly and continuously to the upper surface of the fin plate accommodation portion 30 through the slope 40*a*, serves to allow cooling water to flow smoothly to the upper surface of the fin plate accommodation portion 30. Especially, the configuration that the periphery of each opening 28 includes the straight portion 28*a*, allows to set larger the width of the inter-port passage 40 while setting the opening area of the opening 28 larger as required, and thereby maximize the quantity of cooling water flowing in the clearance between the fin plate accommodation portions 30.

In this way, according to the present embodiment, it is possible to enhance the ratio of the quantity of cooling water flowing through the cooling water passages 12 between flat tubes 2 with respect to the whole quantity of cooling water flowing in the case 10, and thereby enhance the heat exchange efficiency between the cooling water and the working oil flowing in the fin plate accommodation portion 30.

In this configuration, the longitudinal size of each guide wall 34 at the lateral periphery of the flat tube 2 can be minimized. This allows to easily perform an inspection operation to visually check the condition of joining of the inside embossed portions 36 after the brazing operation in the furnace, as can be understood from FIGS. 1 and 8.

In the present embodiment, the port-side guide wall 29*a* and the extension part 30*b*, which constitute the nozzle portion 42, form the substantially triangular space continuous with the rectangular space of the fin plate accommodation portion 30 in the internal space of the flat tube 2. Accordingly, the oil passage is formed to gradually spread in the width direction as followed from the internal space of the oil port 37 (boss portion 29) toward the end surface of the fin plate 23. This serves to reduce the flow resistance of the oil passage and set uniform the flow distribution.

The present embodiment may be modified variously as follows. Although each flat tube 2 includes two openings at one longitudinal end portion except for the lowest flat tube 2 connected to the mounting flange 3 in the present embodiment, the each flat tube 2 may have a single opening or three or more openings. Although the guide wall 34 is formed integrally with the flange 33 at the periphery of the upper plate 22, the guide wall 34 may be provided separately from the flange 33.

The entire contents of Japanese Patent Application 2013-243427 filed Nov. 26, 2013 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An oil cooler comprising:

a plurality of flat tubes layered together with a clearance with respect to one another in a layering direction, and configured to be mounted in a case, the case being structured to allow cooling water to flow in the case through the clearance in a longitudinal direction of the flat tubes, and each tube of the plurality of flat tubes being structured to allow working oil to flow in each respective tube of the plurality of flat tubes; wherein each tube of the plurality of flat tubes includes a first plate;

a second plate including a periphery joined with a periphery of the first plate;

a fin plate held between the first plate and the second plate; and an oil port having a cylindrical shape having a longitudinal axis extending in the layering direction, and provided at first longitudinal end portions of the first plate and the second plate, the first longitudinal end portions being configured to receive inflow of cooling water;

each tube of the plurality of flat tubes is connected to one another via the oil port;

wherein, in a respective flat tube of the plurality of flat tubes, the first plate is recessed to form a fin plate accommodation portion accommodating the fin plate, wherein a first longitudinal end portion of the first plate is outside of the fin plate accommodation portion in the longitudinal direction of the respective tube of the plurality of flat tubes;

the second plate has a flat shape covering the fin plate accommodation portion of the first plate;

the first longitudinal end portion of the first plate and the first longitudinal end portion of the second plate are joined together to form a thin portion of the respective tube of the plurality of flat tubes; and the oil port is provided at the thin portion of the respective tube of the plurality of flat tubes and located adjacent to the fin plate accommodation portion of the first plate;

each tube of the plurality of flat tubes includes a guide wall at a lateral periphery thereof, wherein the guide wall faces the oil port in a width direction of the plurality of flat tubes, and has a rectangular shape having a longitudinal axis extending in the longitudinal direction of the respective flat tube of the plurality of flat tubes, and projects in the layering direction, and has a projecting end facing an adjacent one of the plurality of flat tubes, wherein an entirety of the projecting end is out of contact with the adjacent flat tube; and the guide wall, the thin portion, and a lateral wall of the oil port form a nozzle portion of the respective tube of the plurality of flat tubes to guide cooling water in the longitudinal direction of the respective tube of the plurality of flat tubes.

2. The oil cooler as claimed in claim 1, wherein:

each tube of the plurality of flat tubes includes two of the oil ports arranged in the width direction of the plurality of flat tubes;

each tube of the plurality of flat tubes includes an inter-port passage formed between the oil ports, wherein the inter-port passage extends from the thin portion to an adjacent longitudinal end of the fin plate accommodation portion; and the inter-port passage includes a slope connected between a level of the thin portion and a level of the fin plate accommodation portion.

3. The oil cooler as claimed in claim 1, wherein the lateral wall of the oil port includes a base portion extending toward an adjacent longitudinal end of the fin plate accommodation portion and expanding in the width direction of the plurality of flat tubes.

4. The oil cooler as claimed in claim 3, wherein:

the base portion of the lateral wall of the oil port includes a slope at a portion of the base portion expanding in the width direction of the plurality of flat tubes; and the slope is connected between a level of the thin portion and a level of the fin plate accommodation portion.

5. The oil cooler as claimed in claim 1, wherein the guide wall extends in a range covering an adjacent longitudinal end of the fin plate accommodation portion in the longitudinal direction of the respective tube of the plurality of flat tubes.

6. The oil cooler as claimed in claim 5, wherein:

the oil cooler includes a plurality of embossed portions provided in each clearance for keeping each respective clearance; and the guide wall extends between a central portion of the oil port and one of the embossed portions in the longitudinal direction of the respective tube of the plurality of flat tubes, wherein the one of the embossed portions is closer to the oil port in the longitudinal direction of the respective tube than at least another of the embossed portions.

* * * * *